US009251795B2

(12) United States Patent
Patel et al.

(10) Patent No.: US 9,251,795 B2
(45) Date of Patent: Feb. 2, 2016

(54) ADAPTIVE AUDIO CODEC SELECTION DURING A COMMUNICATION SESSION

(71) Applicant: Apple Inc., Cupertino, CA (US)

(72) Inventors: Nirav R. Patel, Cupertino, CA (US); Hyeonkuk Jeong, Saratoga, CA (US); Sundararaman V. Shiva, Los Gatos, CA (US); Hassan Shojania, Mountain View, CA (US); Roberto Garcia, Sunnyvale, CA (US); Yan Yang, San Jose, CA (US); James O. Normile, Los Altos, CA (US); Joe S. Abuan, San Jose, CA (US)

(73) Assignee: Apple Inc., Cupertino, CA (US)

( * ) Notice: Subject to any disclaimer, the term of this patent is extended or adjusted under 35 U.S.C. 154(b) by 150 days.

(21) Appl. No.: 14/018,340

(22) Filed: Sep. 4, 2013

(65) Prior Publication Data

US 2014/0067405 A1 Mar. 6, 2014

Related U.S. Application Data

(60) Provisional application No. 61/696,794, filed on Sep. 4, 2012.

(51) Int. Cl.
*G10L 19/00* (2013.01)
*G10L 19/22* (2013.01)

(52) U.S. Cl.
CPC ..... *G10L 19/00* (2013.01); *G10L 19/22* (2013.01)

(58) Field of Classification Search
USPC ..... 704/500–504
See application file for complete search history.

(56) References Cited

U.S. PATENT DOCUMENTS

| | | | | |
|---|---|---|---|---|
| 7,443,879 | B2 | 10/2008 | Ejzak et al. | |
| 7,529,675 | B2 | 5/2009 | Maes | |
| 8,289,870 | B2 | 10/2012 | Michaelis et al. | |
| 2004/0037312 | A1 * | 2/2004 | Spear | 370/465 |
| 2004/0128125 | A1 * | 7/2004 | Makinen et al. | 704/219 |
| 2006/0041431 | A1 * | 2/2006 | Maes | 704/270.1 |
| 2010/0063818 | A1 | 3/2010 | Mason et al. | |
| 2011/0261792 | A1 * | 10/2011 | Oerton et al. | 370/335 |
| 2012/0165006 | A1 | 6/2012 | Ge et al. | |

* cited by examiner

*Primary Examiner* — Leonard Saint Cyr
(74) *Attorney, Agent, or Firm* — Downey Brand LLP

(57) ABSTRACT

A method for adaptive audio codec selection during a communication session is disclosed. The method can include negotiating a set of audio codecs for use during the communication session. The method can further include defining multiple audio tiers. Each audio tier can be associated with a network condition and can define an audio codec from the set of audio codecs for use in the associated network condition. The method can also include using a first audio codec during the wireless communication session. The method can additionally include determining a changed network condition selecting a second audio codec by determining the audio tier corresponding to the changed network condition. The method can further include, in response to the changed network condition, switching from the first audio codec to a second audio codec that is defined by an audio tier having an associated network condition corresponding to the changed network condition.

20 Claims, 10 Drawing Sheets

ADAPTIVE AUDIO CODEC SELECTION DURING A COMMUNICATION SESSION

CROSS-REFERENCE TO RELATED APPLICATIONS

This application claims priority to U.S. Provisional Patent Application No. 61/696,794, filed on Sep. 4, 2012, which is incorporated herein in its entirety by reference.

FIELD OF THE DESCRIBED EMBODIMENTS

The described embodiments relate generally to communication technology and more particularly to adaptive audio codec selection during a communication session.

BACKGROUND

Wireless communication devices participating in a communication session can use an audio codec to encode and decode audio data exchanged during the communication session. Many audio codecs have optimal operating conditions in which they provide a higher audio quality. When used outside of their optimal operating conditions, audio codecs often provide a noticeably lower audio quality, which can negatively impact user experience. As such, current wireless communication devices often select an audio codec at the outset of a communication session based on network conditions observed at that time and use the audio codec throughout the communication session.

However, network conditions can fluctuate over time, and a wireless communication device can experience a wide range of conditions during a communication session. Thus, while an audio codec selected based on network conditions observed at the outset of a communication session can initially provide good audio quality, if network conditions change to a level outside of the optimal range of the audio codec during the course of the communication session, the audio quality experienced by the user can degrade significantly, thus making it difficult to maintain a coherent audio stream and negatively impacting user experience.

BRIEF SUMMARY OF SOME DISCLOSED EMBODIMENTS

Some embodiments disclosed herein provide for adaptive audio codec selection during a communication session, such as a voice call, video call, mobile teleconferencing session, and/or other communication session. More particularly, a communication device in accordance with some example embodiments can negotiate a set of audio codecs during a communication session setup phase for use during the wireless communication session with one or more further communication devices participating in the communication session. The set of audio codecs can include a plurality of audio codecs that are supported by the communication devices participating in the wireless communication session. A communication device in accordance with such example embodiments can further define a plurality of audio tiers, with each audio tier being associated with a respective network condition and defining an audio codec from the negotiated set of audio codecs for use in the associated network condition. During the communication session, the communication device of such example embodiments can respond to a changed network condition by selecting and switching to an audio codec defined by an audio tier corresponding to the changed network condition. Accordingly, such example embodiments provide for adaptive audio codec selection by which an audio codec appropriate for current network conditions can be selected so as to provide better audio quality throughout the communication session. User experience can accordingly be improved by maintaining greater continuity in audio quality throughout a communication session even when network conditions evolve during the communication session.

This Summary is provided merely for purposes of summarizing some example embodiments so as to provide a basic understanding of some aspects of the disclosure. Accordingly, it will be appreciated that the above described example embodiments are merely examples and should not be construed to narrow the scope or spirit of the disclosure in any way. Other embodiments, aspects, and advantages will become apparent from the following detailed description taken in conjunction with the accompanying drawings which illustrate, by way of example, the principles of the described embodiments.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION OF SELECTED EMBODIMENTS

Example embodiments disclosed herein provide for adaptive audio codec selection during a communication session, such as a voice call, video call, mobile teleconferencing session, and/or other communication session in which a communication device can participate. For example, a communication device in accordance with some example embodiments can negotiate a set of audio codecs during a communication session setup phase, such as during a call setup phase, for use during the wireless communication session with one or more other wireless communication devices participating in the communication session. The set of audio codecs can include a plurality of audio codecs that are supported by the communication devices participating in the communication session. A communication device in accordance with such example embodiments can further define a plurality of audio tiers, with each audio tier being associated with a respective network condition and defining an audio codec from the negotiated set of audio codecs for use in the associated network condition. During the communication session, a communication device in accordance with some such example embodiments can respond to a changed network condition by selecting and switching to an audio codec defined by an audio tier corresponding to the changed network condition.

In this regard, some example embodiments disclosed herein provide for adaptive audio codec selection during a communication session such that a communication device can switch audio codecs one or more times during a communication session to account for changing network conditions experienced during the communication session. Accordingly, more consistent audio quality can be maintained during the communication session, as, if network conditions evolve to be outside of the optimum operating conditions of an audio codec, a communication device can switch audio codecs during the session to an audio codec that is more appropriate to the present network conditions. Degradation of audio quality that can result from changing network conditions during a communication session can be reduced, or even avoided, by such example embodiments, thus improving user experience. Such example embodiments can be particularly advantageous for communication sessions over wireless channels in which network conditions can change relatively rapidly during the course of a communication session. However, it will be appreciated that such example embodiments can also be applied to wireline connections that can experience fluctuating bandwidth conditions.

Figure 1:
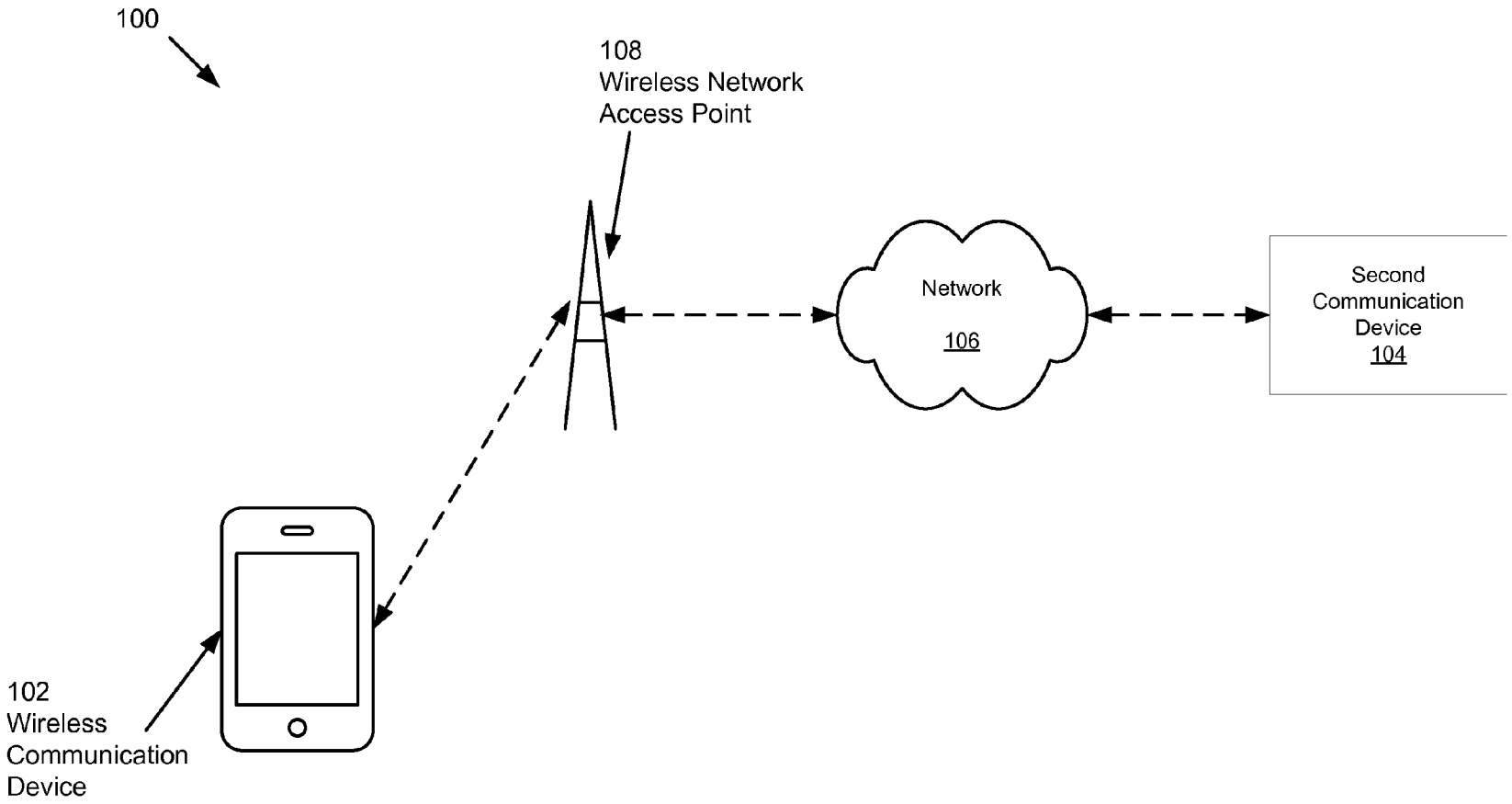
FIG. 1 illustrates a wireless communication system in accordance with some example embodiments.

FIG. 1 illustrates a wireless communication system 100 in accordance with some example embodiments. The wireless communication system 100 can include a plurality of communication devices, including the wireless communication device 102 and second communication device 104.

The wireless communication device 102 can be any communication device configured to wirelessly access a network, such as the network 106, via a radio access technology (RAT) and engage in a communication session with another device over the network. By way of non-limiting example, the wireless communication device 102 can be embodied as a cellular phone, such as a smart phone device, a tablet computing device, a laptop computing device, or other computing device that can be configured to wirelessly access a network.

As illustrated in FIG. 1, the wireless communication device 102 can wirelessly access network 106 via the wireless network access point 108. As another example, in some example embodiments, the wireless communication device 102 can be tethered to a device that can wirelessly access the wireless network access point 108. The wireless network access point 108 can be embodied as any access point that can be configured to wirelessly provide network access to a wireless communication device, such as wireless communication device 102. For example, in some embodiments, wireless network access point 108 can be embodied as a cellular base station, such as, by way of non-limiting example, a base transceiver station (BTS), node B, evolved node B (eNB), femtocell, and/or other type of cellular base station. As a further example, in some embodiments, wireless network access point 108 can be embodied as a wireless local area network (WLAN) access point, such as a wireless router, wireless bridge, and/or other type of access point that can be used to access a WLAN. It will be appreciated, however, that the foregoing example embodiments of the wireless network access point 108 are non-limiting, and that the embodiment of the wireless network access point 108 can vary depending on a type of RAT used for communication between the wireless communication device 102 and wireless network access point 108.

Any present or future RAT can be used for communication between wireless communication device 102 and wireless network access point 108 within the scope of the disclosure. For example, in some embodiments, such as in some embodiments in which wireless network access point 108 is embodied as a cellular base station, a cellular RAT can be used for communication between wireless communication device 102 and wireless network access point 108. For example, in some embodiments in which a cellular RAT is used, a fourth generation (4G) RAT, such as a Long Term Evolution (LTE) RAT, including LTE, LTE-Advanced (LTE-A), and/or the like can be used for communication between wireless communication device 102 and wireless network access point 108. As another example, in some embodiments in which a cellular RAT is used, a third generation (3G) RAT, such as a Universal Mobile Telecommunications System (UMTS) RAT, such as Wideband Code Division Multiple Access (WCDMA) or Time Division Synchronous Code Division Multiple Access (TD-SCDMA); a CDMA2000 RAT (e.g., 1xRTT) or other RAT standardized by the Third Generation Partnership Project 2 (3GPP2); and/or other 3G RAT can be used for communication between wireless communication device 102 and wireless network access point 108. As a further example, in some embodiments in which a cellular RAT is used, a second generation (2G) RAT, such as a Global System for Mobile Communications (GSM) RAT, and/or other 2G RAT can be used for communication between wireless communication device 102 and wireless network access point 108. It will be appreciated, however, that the foregoing examples of cellular RATs are provided by way of example, and not by way of limitation. In this regard, other present or future developed cellular RATs, including various fifth generation (5G) RATs now in development, can be used for communication between wireless communication device 102 and wireless network access point 108 within the scope of the disclosure.

In some example embodiments, a non-cellular RAT can be used for communication between wireless communication device 102 and wireless network access point 108. For example, in some embodiments, such as some embodiments in which wireless network access point 108 is embodied as a WLAN access point, a WLAN RAT, such as an Institute of Electrical and Electronics Engineers (IEEE) standardized Wi-Fi RAT (e.g., IEEE 802.11 a/b/g/n/ac/ad/etc.), can be used for communication between wireless communication device 102 wireless network access point 108. As a further example, in some embodiments, a wireless personal area network (WPAN) RAT, such as Bluetooth, ZigBee, and/or the like can be used for communication between wireless communication device 102 and wireless network access point 108.

While the foregoing example discussion includes the wireless communication device 102 accessing the network 106 via a wireless communication connection, it will be appreciated techniques and operations disclosed herein with respect to various example embodiments can also be provided to communication sessions over wireline connections. Thus, for example, some example embodiments can be applied to a wireless communication device 102 or other communication device connected to a landline network connection with a backhaul that can experience fluctuating bandwidth. As such, it will be appreciated that techniques and operations described in connection with embodiments in which wireless communication device 102 accesses the network 106 via a wireless connection can be applied mutatis mutandis to a communication device accessing a network via a wireline connection that can experience fluctuating bandwidth.

The second communication device 104 can be any communication device that can be configured to engage in a communication session with one or more further communication devices, such as wireless communication device 102. In some example embodiments, the second communication device 104 can also be a wireless communication device, and thus can be embodied similarly to wireless communication device 102 and can access the network 106 via a wireless connection to a wireless network access point, such as a wireless network access point 108. In such embodiments, the second communication device 104 can use any present or future RAT, including, for example, one or more of the RATs described above with respect to the wireless communication device 102 to access the network 106 and engage in a communication session with the wireless communication device 102. It will be appreciated, however, that in some embodiments, second communication device 104 can access the network 106 and participate in a communication session with wireless communication device 102 via a wireline connection to the network 106.

The network 106 can be embodied as any network or combination of networks that can support a communication session between two or more communication devices, such as wireless communication device 102 and second communication device 104. By way of non-limiting example, the network 106 can include one or more wireless networks (e.g., one or more cellular networks, one or WLANs, and/or the like), one or more wireline networks, or some combination thereof, and, in some example embodiments, can include the Internet.

The wireless communication device 102 and second communication device 104 can be configured to initiate a communication session with each other via any technique that can be used to initiate a communication session. For example, in some embodiments in which a communication session in which the wireless communication device 102 and second communication device 104 can participate can be a call, such as a voice call, video call, conference call, video conference call, and/or the like, one of the wireless communication device 102 and second communication device 104 (e.g., the calling communication device) can place a call to the other of the wireless communication device 102 and second communication device 104 (e.g., the called communication device) to initiate a communication session.

In some example embodiments, the wireless communication device 102 and/or second communication device 104 can have a media streaming application implemented thereon, which can be configured to support a communication session. By way of non-limiting example, the media streaming application can be a video call and/or video conferencing application, such as Apple® Inc.'s FaceTime®.

Figure 2:
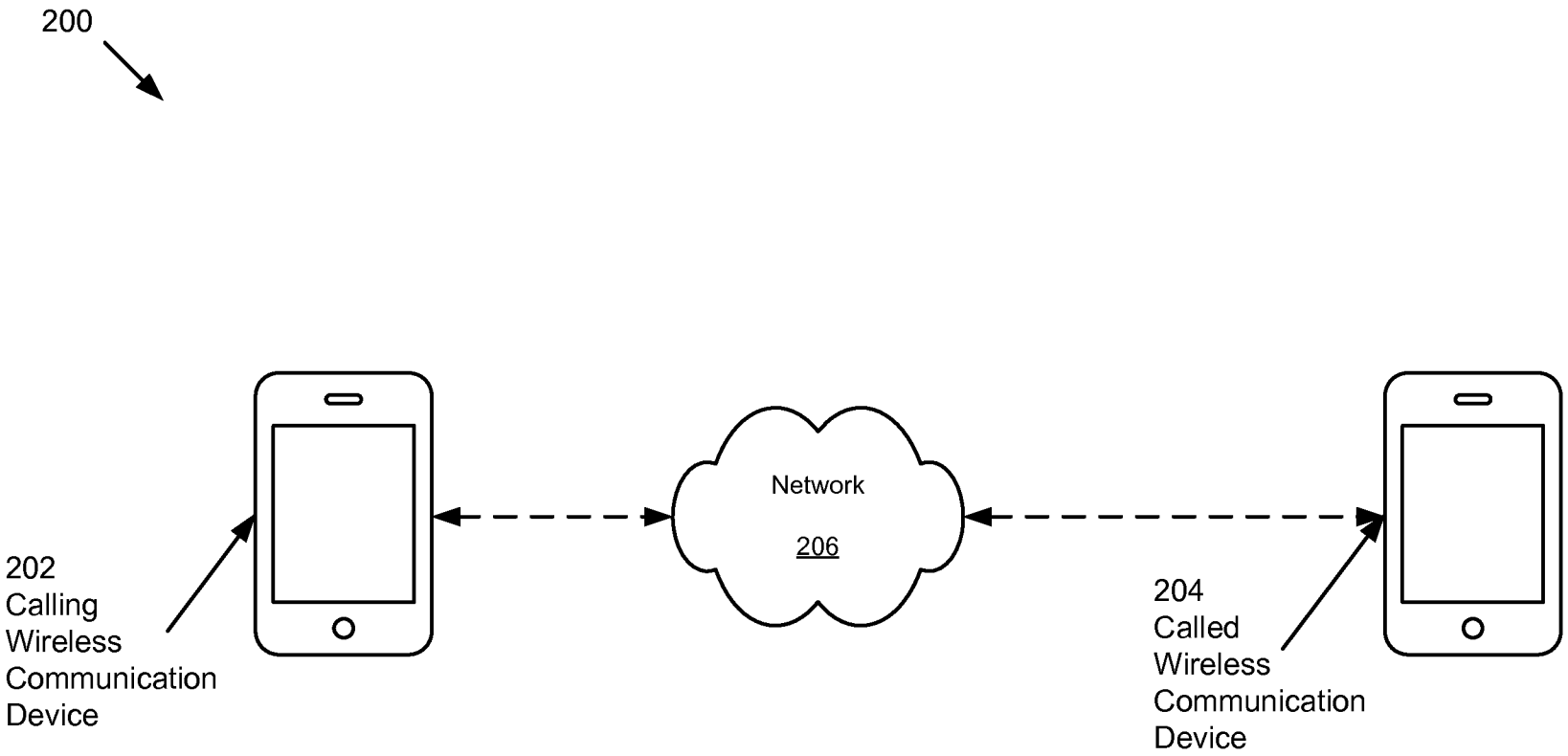
FIG. 2 illustrates another example wireless communication system in accordance with some example embodiments.

FIG. 2 illustrates another example wireless communication system in accordance with some example embodiments. The wireless communication system 200 can include a plurality of wireless communication devices, including the calling wireless communication device 202 and called wireless communication device 204. The wireless communication devices 202 and 204 can each be any communication device configured to wirelessly access a network, such as the network 206 via a radio access technology (RAT) and engage in a communication session with another device over the network. By way of non-limiting example, the wireless communication devices 202 and 204 can each be a cellular phone, such as a smart phone device, a tablet computing device, a laptop computing device, or other computing device that can be configured to operate within wireless communication system 200. In this regard, the system 200 illustrated in FIG. 2 can be an embodiment of the system 100 in which the second communication device 104 is also embodied as a wireless communication device and one of the wireless communication device 102 and second communication device 104 (e.g., the calling wireless communication device 202) can place a call to the other of the wireless communication device 102 and second communication device 104 (e.g., the called wireless communication device 204) to initiate a communication session.

The network 206 can include one or more wireless networks (e.g., one or more cellular networks, one or more wireless local area networks, and/or the like), one or more wireline networks or some combination thereof, and in some example embodiments can include the Internet. In some example embodiments, the network 206 can, for example, be an embodiment of the network 106.

The wireless communication devices 202 and 204 can each be configured to wirelessly access the network 206 via one or more network access points. For example, one or more of the calling wireless communication device 202 or the called wireless communication device 204 can be configured to access the network 206 via a cellular base station, such as, by way of non-limiting example, a BTS, a node B, an eNB, or the like. As a further example, one or more of the calling wireless communication device 202 or the called wireless communication device 204 can be configured to access the network 206 via a wireless local area network (WLAN) access point. In some embodiments, one or more of the calling wireless communication device 202 or the called wireless communication device 204 can be configured to access the network 206 via a wireless network access point 108. In some example embodiments, one or more of the calling wireless communication device 102 or the called wireless communication device 104 can be a device configured to wirelessly access the network 206 via any one or more of a plurality of RATs.

The calling wireless communication device 202 can be configured to initiate a communication session with the called wireless communication device 204. By way of non-limiting example, the calling wireless communication device 202 can call the called wireless communication device 204 to initiate a video call, mobile teleconference, audio only call, and/or other communication session in which audio can be exchanged between the wireless communication devices 202 and 204. The communication session can be supported by the network 206. In some example embodiments, the calling wireless communication device 202 and/or the called wireless communication device 204 can implement a media streaming application configured to support a communication session. By way of non-limiting example, the media streaming application can be a video call or video conferencing application, such as Apple® Inc.'s FaceTime®.

Figure 3:
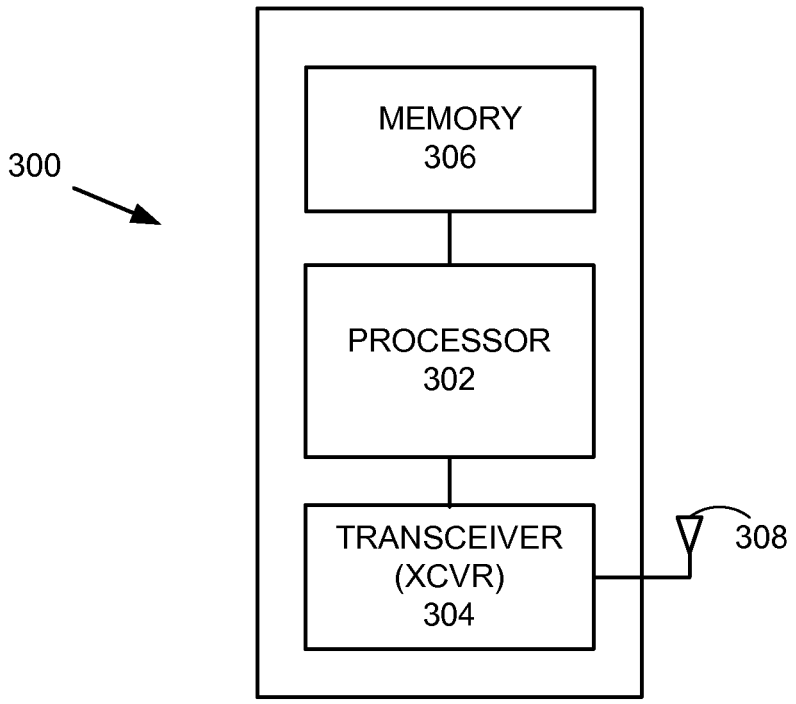
FIG. 3 illustrates a block diagram of an apparatus that can be implemented on a communication device in accordance with some embodiments.

FIG. 3 is a block diagram of an apparatus 300 that can be implemented on a communication device, such as wireless communication device 102, second communication device 104, calling wireless communication device 202, and/or called wireless communication device 204, in accordance with some embodiments. The apparatus 300 can include a processor 302 coupled with memory 306 and also coupled with a wireless transceiver(s) 304. Processor 302 can be configured to read, write and execute processor instructions stored in memory 306. Processor 302 can also be configured to control wireless transceiver(s) 304. The wireless transceiver 304 can be configured to use the antenna 308 to support wireless communication with one or more wireless devices and/or networks. For example, in some embodiments, wireless transceiver 304 can connect to wireless networks, such as via a wireless network access point 108 and/or other wireless network access point. Accordingly, in some such example embodiments, the wireless transceiver 304 can be configured to support transmission of audio packets for a communication session via a wireless connection to the network 106 and/or to the network 206.

Figure 4:
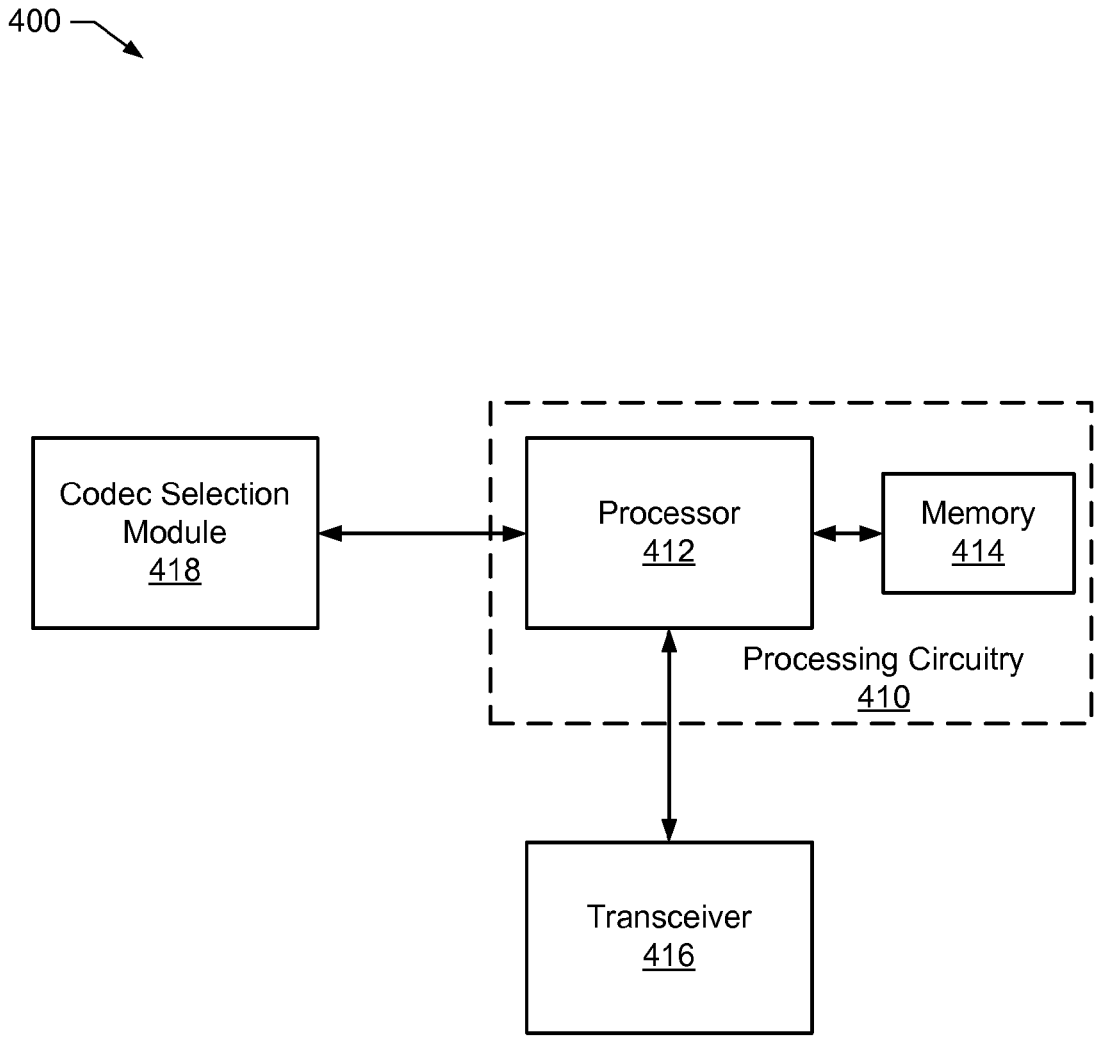
FIG. 4 illustrates a block diagram of another example apparatus that can be implemented on a communication device in accordance with some example embodiments.

FIG. 4 illustrates a block diagram of another example apparatus that can be implemented on a communication device, such as wireless communication device 102, second communication device 104, calling wireless communication device 202, and/or called wireless communication device 204, in accordance with some embodiments. In this regard, FIG. 4 illustrates an apparatus 400 that can, when implemented on a computing device, such as wireless communication device 102, second communication device 104, calling wireless communication device 202, and/or called wireless communication device 204, enable the computing device to operate within the system 100 and/or within the system 200 in accordance with one or more example embodiments. It will be appreciated that the components, devices or elements illustrated in and described with respect to FIG. 4 below may not be mandatory and thus some may be omitted in certain embodiments. Additionally, some embodiments can include further or different components, devices or elements beyond those illustrated in and described with respect to FIG. 4.

In some example embodiments, the apparatus 400 can include processing circuitry 410 that is configurable to perform actions in accordance with one or more example embodiments disclosed herein. In this regard, the processing circuitry 410 can be configured to perform and/or control performance of one or more functionalities of a communication device in accordance with various example embodiments, and thus can provide means for performing functionalities of a communication device, such as wireless communication device 102, second communication device 104, calling wireless communication device 202, and/or called wireless communication device 204, in accordance with various example embodiments. The processing circuitry 410 can be configured to perform data processing, application execution and/or other processing and management services according to one or more example embodiments.

In some embodiments, the apparatus 400 or a portion(s) or component(s) thereof, such as the processing circuitry 410, can include one or more chipsets, which can each include one or more chips. The processing circuitry 410 and/or one or more further components of the apparatus 400 can therefore, in some instances, be configured to implement an embodiment on a single chip or chipset. In some example embodiments in which one or more components of the apparatus 400 are embodied as a chipset, the chipset can be capable of enabling a computing device to operate in the system 100 and/or the system 200 when implemented on or otherwise operably coupled to the computing device.

In some example embodiments, the processing circuitry 410 can include a processor 412 and, in some embodiments, such as that illustrated in FIG. 4, can further include memory 414. The processor 412 can, for example, be an embodiment of the processor 302. The memory 414 can, for example, be an embodiment of the memory 306. As such, in some example embodiments, the processing circuitry 410 can be at least partially embodied by the processor 302 and/or memory 306. The processing circuitry 410 can be in communication with or otherwise control a transceiver 416 and/or codec selection module 418.

The processor 412 can be embodied in a variety of forms. For example, the processor 412 can be embodied as various hardware-based processing means such as a microprocessor, a coprocessor, a controller or various other computing or processing devices including integrated circuits such as, for example, an ASIC (application specific integrated circuit), an FPGA (field programmable gate array), some combination thereof, or the like. Although illustrated as a single processor, it will be appreciated that the processor 412 can comprise a plurality of processors. The plurality of processors can be in operative communication with each other and can be collectively configured to perform one or more functionalities of a communication device as described herein. In some example embodiments, the processor 412 can be configured to execute instructions that can be stored in the memory 414 or that can be otherwise accessible to the processor 412. As such, whether configured by hardware or by a combination of hardware and software, the processor 412 capable of performing operations according to various embodiments while configured accordingly.

In some example embodiments, the memory 414 can include one or more memory devices. Memory 214 can include fixed and/or removable memory devices. In some embodiments, the memory 414 can provide a non-transitory computer-readable storage medium that can store computer program instructions that can be executed by the processor 412. In this regard, the memory 414 can be configured to store information, data, applications, instructions and/or the like for enabling the apparatus 400 to carry out various functions in accordance with one or more example embodiments. In some embodiments, the memory 414 can be in communication with one or more of the processor 412, transceiver 416, or codec selection module 418 via a bus (or buses) for passing information among components of the apparatus 400.

The apparatus 400 can further include a transceiver 416. The transceiver 416 can, for example, be an embodiment of the transceiver 304. The transceiver 416 can be configured to enable the apparatus 400 to send (e.g., transmit) wireless signals to and receive signals from a wireless network via a connection to a wireless network access point, such as the wireless network access point 108. As such, the transceiver 416 can be configured to support any type of RAT that may be used to support commotion over a wireless channel between a communication device and a network. Thus, for example, the transceiver 416 can be configured to support communication via any type of RAT that can be used for communication between a wireless communication device and a wireless network access point 108.

The apparatus 400 can further include codec selection module 418. The codec selection module 418 can be embodied as various means, such as circuitry, hardware, a computer program product comprising a computer readable medium (for example, the memory 414) storing computer readable program instructions that are executable by a processing device (for example, the processor 412), or some combination thereof. The codec selection module 418 can be configured to adaptively select an audio codec during a communication session, such as based on network conditions experienced during the communication session, in accordance with one or more embodiments disclosed herein.

Figure 5:
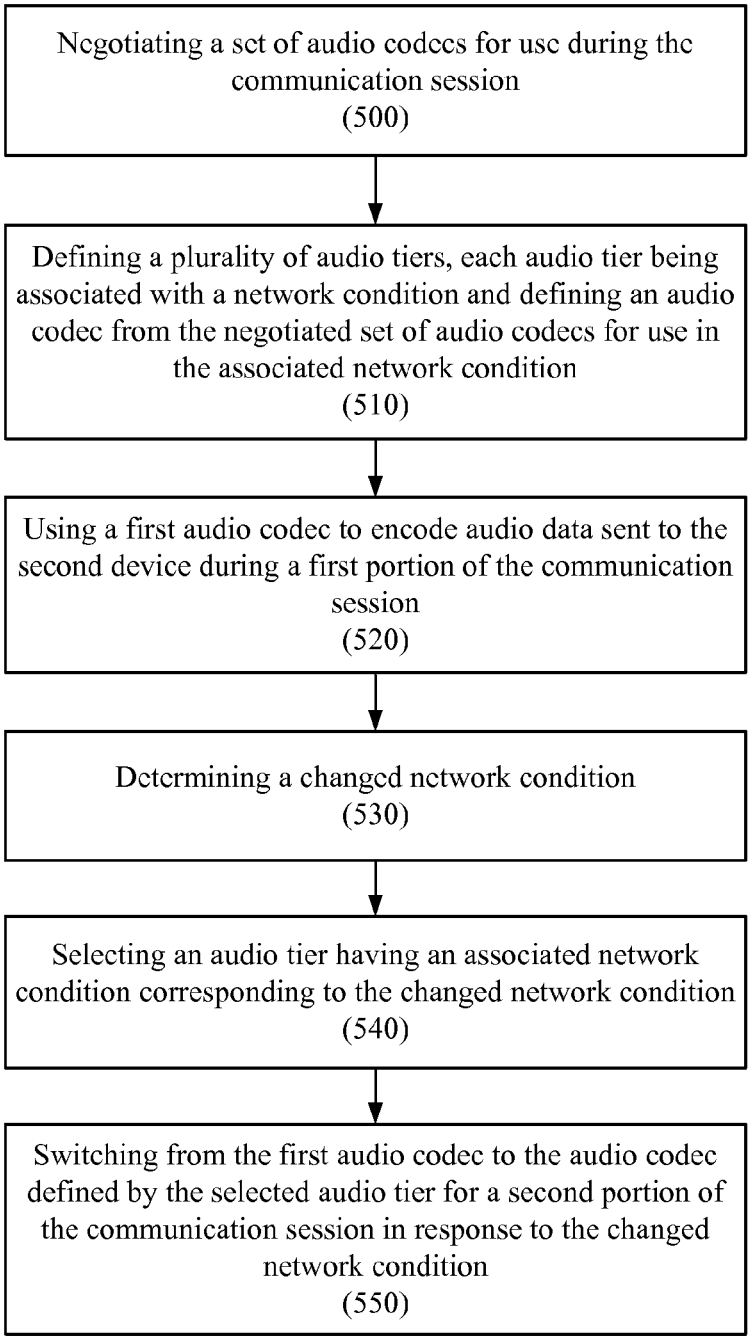
FIG. 5 illustrates a flow chart according to an example method for adaptive audio codec selection during a communication session in accordance with some example embodiments.

FIG. 5 illustrates a flow chart according to an example method for adaptive audio codec selection during a communication session in accordance with some example embodiments. In this regard, FIG. 5 illustrates operations that can be performed by a communication device, such as wireless communication device 102, second communication device 104, calling wireless communication device 202, called wireless communication device 204, and/or the like, in accordance with some example embodiments. One or more of processor 302, transceiver 304, memory 306, processing circuitry 410, processor 412, memory 414, transceiver 416, or codec selection module 418 can, for example, provide means for performing the operations illustrated in and described with respect to FIG. 5.

Operation 500 can include communication devices participating in the communication session, such as the wireless communication device 102 and second communication device 104 and/or the calling wireless communication device 202 and called wireless communication device 204, negotiating a set of audio codecs for use during the communication session in a communication session setup phase. For example, in some embodiments, the communication devices participating in a communication session can exchange lists of supported audio codecs and a plurality of commonly supported audio codecs can be negotiated for use during the communication session. The communication devices participating in the communication session can additionally set up encoders and decoders for the negotiated set of audio codecs.

In some example embodiments, a communication device can designate one audio codec as a primary codec and the remaining audio codec(s) as secondary codecs. The primary audio codec can be the audio codec that a communication device prefers or otherwise expects to be used the most during the communication session. For example, in some embodiments, an audio codec designated as the primary codec can be the audio codec based upon which the hardware audio configuration of a communication device is configured. In this regard, a hardware sampling rate and block sizes of a communication device can be configured based on the primary codec, and the primary codec can provide the lowest latency and highest quality for the communication device when network conditions support usage of the primary codec.

Operation 510 can include one or more communication devices participating in the communication session defining a plurality of audio tiers during the communication session setup phase. Each audio tier can be associated with a network condition and can define an audio codec from the negotiated set of audio codecs for use in the associated network condition. The network condition associated with an audio tier can, for example, be a bit rate supported by the network (e.g., a network bit rate). In some example embodiments, an audio tier can further provide a codec bit rate (e.g., an audio bit rate) and a bundling factor for use with the defined audio codec in the corresponding network condition. The bundling factor can, for example, define a number of audio packets and/or a length (e.g., in terms of time) of audio data that is included in each network packet, such as a real-time transport protocol (RTP) packet. For example, in some embodiments, depending on the bundling factor, a network packet can include between 1 and 3 encoded audio packets, and/or between 20 and 80 milliseconds of encoded audio data.

In defining the audio tiers, calculations can be performed for each negotiated audio codec at multiple codec parameter combinations, such as at multiple bit rate and bundling factor combinations, supported by a given audio codec. For each codec parameter calculation, an overall network bit rate and quality can be determined. The quality can be defined as a measure of audio quality using the given codec parameter combination. For example, a weighted quality value of between 0.0 and 1.0 can be assigned. The quality can also be defined based on the bundling factor used for the given codec parameter combination. The quality assigned to a given bundling factor can, for example, depend on the RAT used by a participating wireless communication device. For example, a higher quality weight can be given to a higher bundling factor than to a lower bundling factor on a cellular RAT because larger latency can be inherent on a cellular network and there can be less concern with packets being delayed, such as by 20-40 milliseconds, as compared to packets using a smaller bundling factor. On a WLAN, however, a higher quality weight can be given to a lower bundling factor than to a higher bundling factor due to lower latency that can be offered by a WLAN.

As such, for each negotiated audio codec, one or more codec parameter combinations of bit rate and bundling length can be scored based upon a network bit rate and quality supported by the combination. Then, for each of a plurality of audio tiers corresponding to respective network conditions, an audio codec and bit rate/bundling factor combination can be selected that offers the highest quality from the available audio codec configurations at the corresponding network condition. In this regard, audio tiers can enable selection of an audio codec based on network condition factors such as target network bit rate, packet loss, the type of network, packet overhead, and/or other factors. By way of non-limiting example, audio tiers can be defined in some embodiments as follows in Table 1:

| Network Condition | Audio Codec | Bit Rate | Bundling Factor |
|---|---|---|---|
| 10 kilobits per second (kbps) network bit rate | B | w | 3 |
| 16 kbps network bit rate | A | x | 2 |
| 32 kbps network bit rate | A | y | 1 |
| 48 kbps network bit rate | C | z | 2 |

Thus, if a wireless channel is supporting 10 kbps bandwidth, the audio tier corresponding to the network condition can be codec B with a bit rate of w and a bundling factor of 3. If, however, the wireless channel is supporting 100 kbps bandwidth, the audio tier corresponding to the network condition can be codec C with a bit rate of z and a bundling factor of 2. Accordingly, the defined audio tiers can be used to adaptively select a codec combination that is best suited for an observed network condition.

In some example embodiments, one or more defined audio tiers can additionally or alternatively be associated with respective packet loss rates. In some such embodiments, an audio tier can define error correction techniques, such as forward error correction (FEC), packet duplication, and/or other error correction techniques to apply to audio data encoded in accordance with a respective tier. In such example embodiments, an audio tier can be selected based on an observed packet loss rate such that error correction techniques defined by a selected audio tier can be implemented to address the observed packet loss rate.

Operations that can be performed by a communication device to define audio tiers attendant to performance of operation 510 in accordance with some example embodiments are illustrated in and described further herein below with respect to FIG. 7.

In some example embodiments, operations 500 and/or 510 can be performed each time a communication session is initiated. If a device participating in the communication session does not support usage of multiple codecs during a communication session, then the participating devices can negotiate a single codec for use during the communication session rather than performing adaptive codec selection in accordance with a disclosed embodiment. As such, in some example embodiments, if one or more devices participating in a communication session does not support adaptive codec selection, one or more operations illustrated in and described with respect to FIG. 5 can be omitted.

At the outset of the communication session following the setup phase, a first audio codec can be used by a communication device, such as wireless communication device 102, to encode audio data sent to a second device, such as the second communication device 104, during a first portion of the communication session, as illustrated by operation 520. The first audio codec can, for example, be a primary audio codec as indicated during the communication session setup phase, such as when negotiating the set of audio codecs in operation 500. As another example, the first audio codec can be an audio codec selected based on an audio tier corresponding to network conditions observed by the communication device at the outset of the communication session.

Operation 530 can include a participating communication device determining a changed network condition. The changed network condition can, for example, be a change in network bandwidth available over a wireless channel. As another example, the changed network condition can be a change in an observed packet loss rate.

Operation 540 can include the communication device selecting an audio tier having an associated network condition corresponding to the changed network condition. For example, in some embodiments in which audio tiers can be associated with respective network bit rates and the changed network condition can be a changed network bandwidth over a wireless channel, operation 540 can include selecting an audio tier having an associated network bit rate corresponding to the changed network bandwidth. A network bit rate corresponding to the changed network bandwidth can, for example, be a network bit rate that does not exceed the available network bandwidth. As another example, a network bit rate corresponding to the changed network bandwidth can be a network bit rate that does not exceed a threshold that is less than the available network bandwidth by some buffer amount that can be selected to reduce the possibility of congestion. In instances in which multiple audio tiers have associated network bit rates that do not exceed the available network bandwidth (or, in some embodiments, a threshold bandwidth that is less than the available network bandwidth), the audio tier selected as having an associated network bit rate corresponding to the changed network bandwidth can, for example, be the audio tier having the largest associated network bit rate without exceeding the available network bandwidth. Thus, using the example audio tiers defined in Table 1 above, if network bandwidth has dropped from 100 kbps to 20 kbps, the 16 kbps audio tier defining use of codec A with a codec bit rate of x and a bundling factor of 2 can be selected.

Operation 550 can include switching from the first audio codec to the second audio codec in response to the changed network condition. Operation 550 can include the communication device switching from the first audio codec to the audio codec (e.g., a second codec) defined by the selected audio tier for a second portion of the communication session in response to the changed network condition. In this regard, operation 550 can include using the second audio codec to encode audio data sent to a second device, such as the second communication device 104. In some example embodiments, operation 550 can include using the second audio codec in accordance with a codec configuration that can be defined by the selected audio tier. For example, in some example embodiments, operation 550 can include using the second audio codec to encode audio data at a codec bit rate that can be defined by the selected audio tier. In embodiments in which the selected audio tier further defines a bundling factor, encoded audio data can be bundled into network packets that can be sent to the second communication device 104 in accordance with the defined bundling factor.

Operations 530-550 can be repeated multiple times throughout the communication session in order to adapt to changing network conditions. In this regard, in some instances, there can be multiple audio codec switches during the course of a communication session as network conditions evolve during the communication session.

Figure 6:
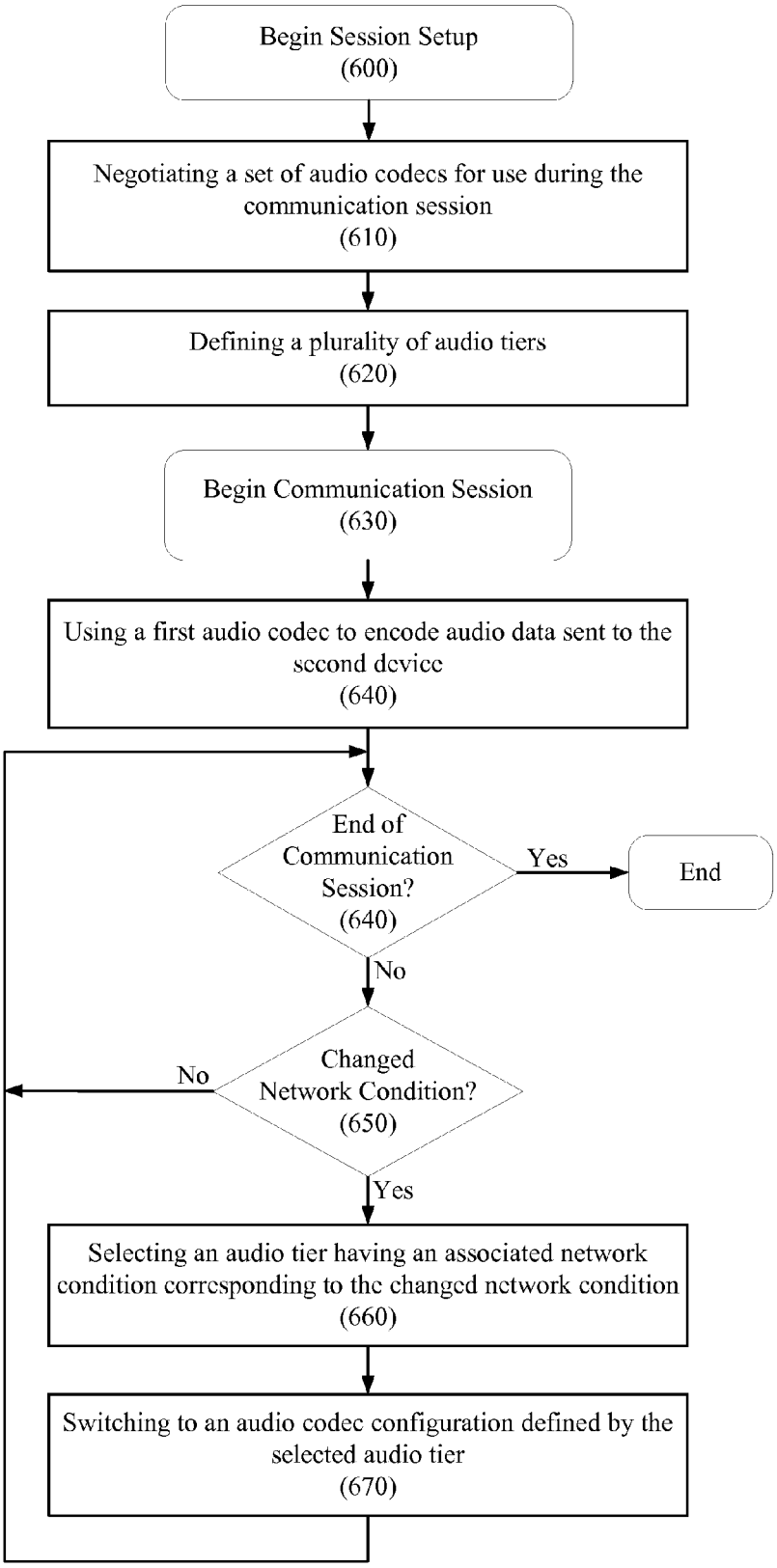
FIG. 6 illustrates a flow chart according to another example method for adaptive audio codec selection during a wireless communication session in accordance with some example embodiments.

FIG. 6 illustrates a flow chart according to another example method for adaptive audio codec selection during a wireless communication session in accordance with some example embodiments. In this regard, FIG. 6 illustrates an example method illustrating how multiple audio codec switches can be made during a communication session in response to changing network conditions, such a through repeated performance of operations 530-550 as described above. The operations illustrated in FIG. 6 can be performed by a communication device, such as wireless communication device 102, second communication device 104, calling wireless communication device 202, called wireless communication device 204, and/or the like, in accordance with some example embodiments. One or more of processor 302, transceiver 304, memory 306, processing circuitry 410, processor 412, memory 414, transceiver 416, or codec selection module 418 can, for example, provide means for performing the operations illustrated in and described with respect to FIG. 6.

Operation 600 can include a communication device, such as wireless communication device 102, beginning a session setup phase attendant to establishing a communication session with a further communication device, such as second communication device 104. Operation 610 can include the communication device negotiating a set of audio codecs for use during the communication session. In this regard, operation 610 can, for example, correspond to an embodiment of operation 500. Operation 620 can include the communication device defining a plurality of audio tiers. In this regard, operation 620 can, for example, correspond to an embodiment of operation 510.

At operation 630, the communication session setup phase can be completed and the communication session can begin. Operation 640 can include the communication device using a first audio codec to encode audio data sent to the second communication device. In this regard, operation 640 can, for example, correspond to an embodiment of operation 520.

Operation 640 can include the communication device determining whether the communication session has ended. If the communication session has been ended, the method can terminate. If, however, the communication session is ongoing, the method can proceed to operation 650, which can include the communication device determining whether a changed network condition meriting a change in audio codecs has occurred. If, no such changed network condition has occurred, the method can return to operation 640. If, however, it is determined at operation 650 that a changed network condition meriting a change in audio codecs has occurred, the method can instead proceed to operation 660.

Operation 660 can include the communication device selecting an audio tier having an associated network condition corresponding to the changed network condition that can be determined to exist in operation 650. In this regard, operation 660 can correspond to an embodiment of operation 540. Operation 670 can include the communication device switching to an audio codec configuration defined by the selected audio tier. In this regard, operation 670 can correspond to an embodiment of operation 550.

After performance of operation 670, the method can return to operation 640. In this regard, monitoring of network conditions and switching of audio codecs as merited can continue until a communication session has ended in accordance with some example embodiments.

Figure 7:
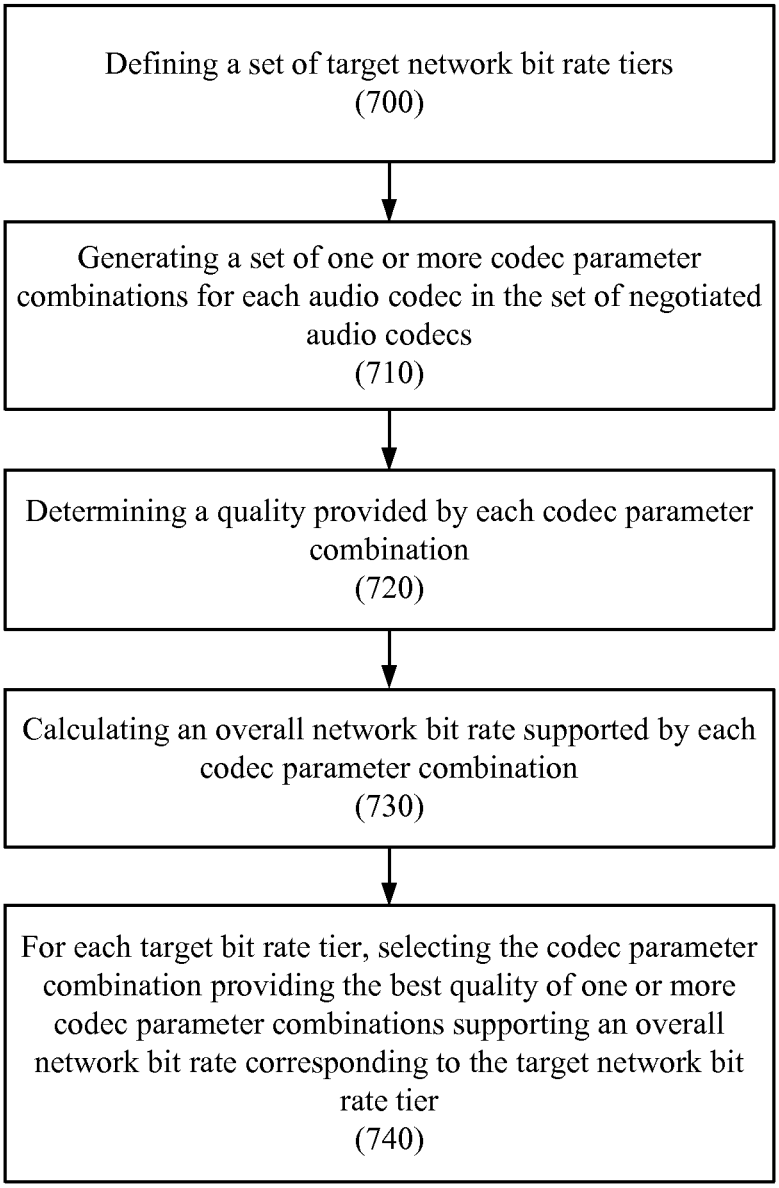
FIG. 7 illustrates a flow chart according to an example method for defining audio tiers in accordance with some example embodiments.

FIG. 7 illustrates a flow chart according to an example method for defining audio tiers in accordance with some example embodiments. In this regard, FIG. 7 illustrates operations that can be performed by a communication device, such as wireless communication device 102, second communication device 104, calling wireless communication device 202, called wireless communication device 204, and/or the like, attendant to the performance of operation 510 and/or operation 620 in accordance with some example embodiments. One or more of processor 302, transceiver 304, memory 306, processing circuitry 410, processor 412, memory 414, transceiver 416, or codec selection module 418 can, for example, provide means for performing the operations illustrated in and described with respect to FIG. 7.

Operation 700 can include a communication device defining a set of target network bit tier rates. In this regard, each target network bit tier rate can represent a respective network condition, such as a respective network bandwidth or network bandwidth range.

Operation 710 can include the communication device generating a set of one or more codec parameter combinations for each audio codec in the set of audio codecs negotiated for use in the communication session. For example, in some embodiments, each codec parameter combination generated for a respective audio codec can include a combination of a codec bit rate and a bundling factor supported by the audio codec.

Operation 720 can include the communication device determining a quality provided by each codec parameter combination. The quality can, for example, be defined as a measure of audio quality using the given codec parameter combination. For example, a weighted quality value of between 0.0 and 1.0 can be assigned to a codec parameter combination. In some example embodiments, the quality assigned to a codec parameter combination can be defined based at least in part on a type of RAT that can be used to support the communication session. For example, a quality can be defined at least in part based on a type of RAT used to support the communication session and the bundling factor for a given codec parameter combination. As an example, in some embodiments, a higher quality weight can be given to a higher bundling factor than to a lower bundling factor on a cellular RAT. On a WLAN, however, a higher quality weight can be given to a lower bundling factor than to a higher bundling factor.

Operation 730 can include the communication device calculating an overall network bit rate supported by each codec parameter combination. The overall network bit rate can, for example, be calculated based at least in part on a codec bit rate and a bundling factor of a codec parameter combination.

Operation 740 can include the communication device selecting a codec parameter combination for each target bit tier rate. The codec parameter combination selected for a given target bit tier rate can, for example, be the codec parameter combination providing the best quality of one or more codec parameter combinations supporting an overall network bit rate corresponding to the target network bit rate tier.

In some example embodiments, one or more hysteresis techniques can be used to determine whether to switch audio codecs in response to a changed network condition. In this regard, switching audio codecs can cause an audio discontinuity. As such, hysteresis techniques can be used to reduce codec switches that might be unnecessary. For example, in some example embodiments, if an audio codec has been switched, switching codecs again can be prohibited for some period of time following the preceding switch. As another example, if a changed network condition is detected, switching codecs can be delayed for some amount of time to ensure that the changed network condition is not an aberration before switching codecs. If, after the period of time for which switching is delayed, the changed network condition remains, then the codec can be switched.

As a hypothetical application of switching hysteresis using the example audio tiers defined in Table 1, the 16 kbps tier may be used at the outset of a communication session. Network conditions could degrade such that it may be determined that available network bandwidth has been reduced to 10 kbps. As such, the audio codec can be switched from audio codec A to audio codec B so that the network is not flooded with additional data. Some time later, such as two seconds later, a measure of network conditions could indicate that network bandwidth has increased to somewhere between 16 kbps and 30 kbps such that the communication device should switch back to audio codec A. However, rather than immediately switching back to audio codec A, in some example embodiments, a delay timer can be set and if, after the timer expires, a measure of network conditions still indicates that the audio codec should be switched back to audio codec A in accordance with the 16 kbps tier, then the audio codec can be switched from audio codec B back to audio codec A.

In some example embodiments, a delay timer can be applied as a hysteresis technique for any audio codec switch regardless of whether the codec change is responsive to degrading network conditions, such as a reduced available network bandwidth, or to improving network conditions, such as a greater available network bandwidth. However, in some example embodiments, a delay timer can be applied prior to switching audio codecs responsive to improving network conditions, but an audio codec switch can be performed without waiting for a delay timer when detecting degrading network conditions so that the network is not flooded with additional data.

Figure 8:
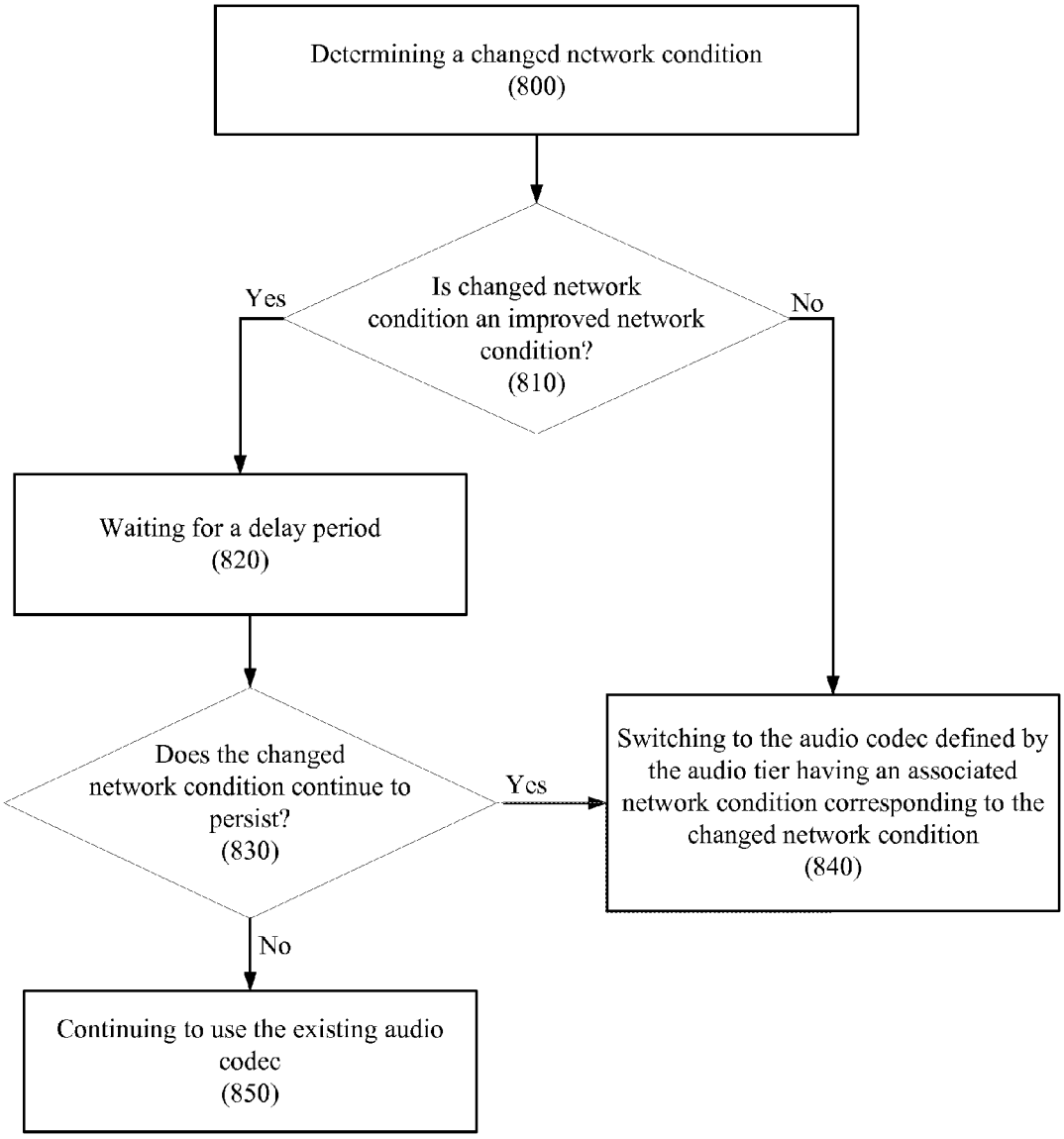
FIG. 8 illustrates a flow chart according to an example hysteresis method for reducing audio codec switches in accordance with some example embodiments.

FIG. 8 illustrates a flow chart according to an example hysteresis method for reducing audio codec switches in accordance with some example embodiments. In this regard, FIG. 8 illustrates operations that can be performed by a communication device, such as wireless communication device 102, second communication device 104, calling wireless communication device 202, called wireless communication device 204, and/or the like, in accordance with some example embodiments. One or more of processor 302, transceiver 304, memory 306, processing circuitry 410, processor 412, memory 414, transceiver 416, or codec selection module 418 can, for example, provide means for performing the operations illustrated in and described with respect to FIG. 8.

Operation 800 can include a communication device determining a changed network condition. The changed network condition can be a changed network condition sufficient to trigger switching audio codecs based on the audio tiers defined for the communication session. Operation 810 can include the communication device determining whether the changed network condition is an improved network condition.

If it is determined at operation 810 that the changed network condition is an improved network condition, the method can proceed to operation 820, which can include the communication device waiting for a delay period prior to switching audio codecs. Operation 830 can include the communication device determining whether the changed network condition continues to persist following the delay period. If it is determined that the changed network condition continues to persist, the method can proceed to operation 840, which can include the communication device switching to the audio codec defined by the audio tier having an associated network condition corresponding to the changed network condition.

If, however, it is determined that the changed network condition does not continue to persist following the delay period, the method can instead proceed to operation 850, which can include continuing to use the existing audio codec. In this regard, audio codec switching can be avoided for transient improvements in network condition to reduce the incidence of audio discontinuities.

If it is determined at operation 810 that the changed network condition is not an improved network condition, such as if the changed network condition is a degraded network condition, the method can proceed directly to operation 840, and the audio codec can be switched without waiting for a delay period.

In some example embodiments, bit rate hysteresis can be applied to avoid potentially unnecessary audio codec switches. In this regard, while the audio tiers can define particular bit rate and bundling factor combinations for the audio codecs, some audio codecs can be capable of operating with acceptable quality at codec bit rates other than the codec bit rate(s) defined by an audio tier. Thus, for example, assume that a codec configuration using audio codec B in accordance with a first audio tier is being used and network conditions indicate that a second audio tier defining a codec configuration using audio codec A should be used. If audio codec B is capable of operating at the bit rate defined by the second audio tier with a quality above a threshold quality, then some example embodiments can continue using audio codec B, but with at the codec bit rate defined by the second audio tier rather than switching to audio codec A. If, however, audio codec B would have a quality below the threshold quality at codec bit rate defined by the second audio tier, then the audio codec can be switched to audio codec A. Accordingly, bit rate hysteresis can be used in some example embodiments to reduce the frequency of audio codec switching and, thus reduce audio discontinuities that can be experienced during a communication session.

Figure 9:
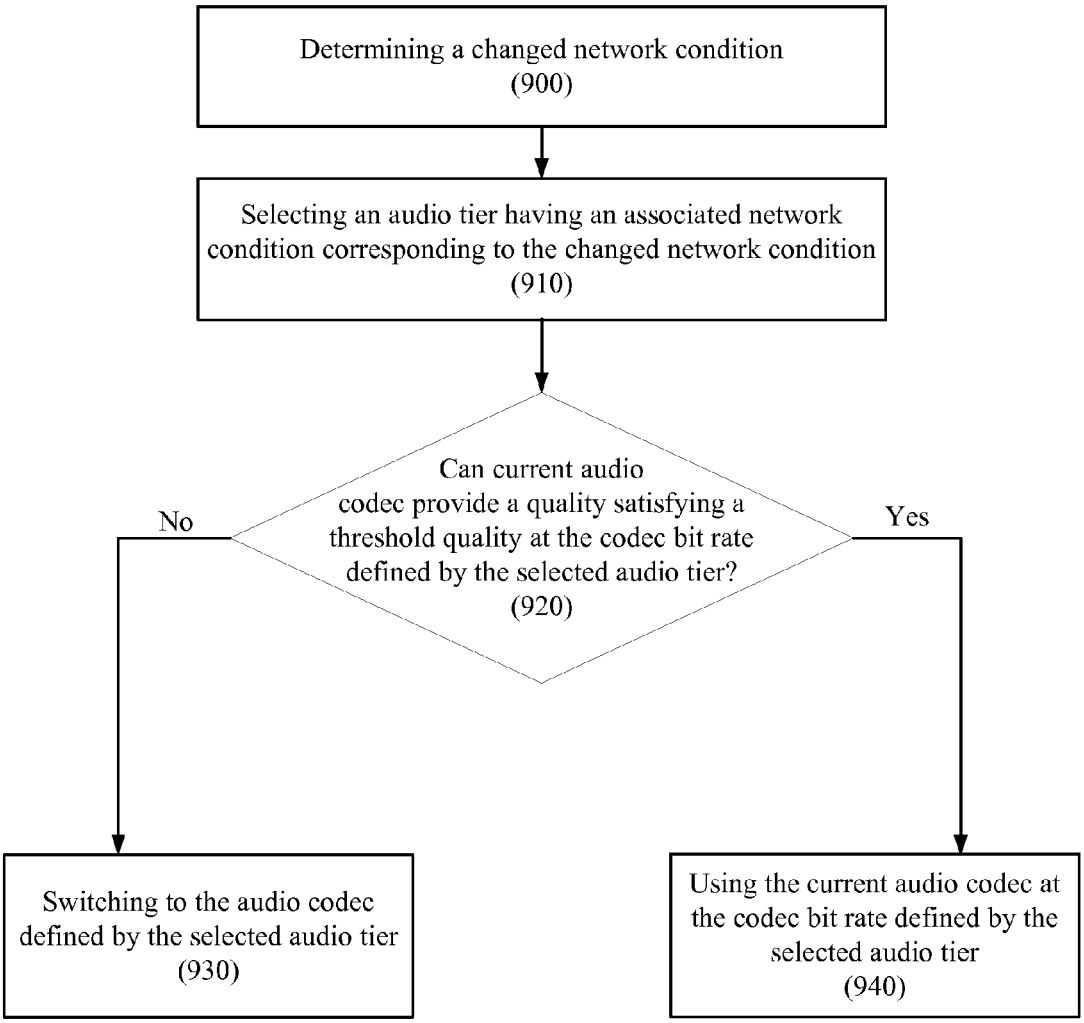
FIG. 9 illustrates a flow chart according to another example hysteresis method for reducing audio codec switches in accordance with some example embodiments.

FIG. 9 illustrates a flow chart according to another example hysteresis method for reducing audio codec switches through bit rate hysteresis in accordance with some example embodiments. In this regard, FIG. 9 illustrates operations that can be performed by a communication device, such as wireless communication device 102, second communication device 104, calling wireless communication device 202, called wireless communication device 204, and/or the like, in accordance with some example embodiments. One or more of processor 302, transceiver 304, memory 306, processing circuitry 410, processor 412, memory 414, transceiver 416, or codec selection module 418 can, for example, provide means for performing the operations illustrated in and described with respect to FIG. 9.

Operation 900 can include a communication device determining a changed network condition. The changed network condition can be a changed network condition sufficient to trigger switching audio codecs based on the audio tiers defined for the communication session. Operation 910 can include the communication device selecting an audio tier having an associated network condition corresponding to the changed network condition.

Operation 920 can include the communication device determining whether the current audio codec can provide a quality satisfying a threshold quality at the codec bit rate defined by the audio tier selected in operation 910. In an instance in which it is determined that the current audio codec cannot provide a quality satisfying the threshold quality, the method can proceed to operation 930, which can include the communication device switching to the audio codec defined by the selected audio tier. If, however, it is determined that the current audio codec can provide a quality satisfying the threshold quality, the method can instead proceed to operation 940, which can include the communication device using the current audio codec at the codec bit rate defined by the selected audio tier. Accordingly, in some embodiments, an audio codec switch can be avoided if the current audio codec can provide an adequate quality at a codec bit rate appropriate to the changed network condition.

It some example embodiments, multiple hysteresis techniques, such as switching hysteresis techniques illustrated in FIG. 8 and bit rate hysteresis techniques illustrated in FIG. 9, can be used in combination. Thus, for example, using the example of FIG. 9, in some embodiments, if it is determined at operation 920 that the current audio codec cannot provide a quality satisfying the threshold quality, the communication device can wait for a delay period to determine if the changed network condition continues to persist prior to switching audio codecs.

In some example embodiments, an audio codec switch can be timed so that it is less noticeable to users. In this regard, an audio codec switch can be performed in some example embodiments during an audio gap (e.g., a period in which the user is not speaking or there is otherwise silence) rather than in the middle of a word. More particularly, speech activity detection can be performed on a sample audio input obtained from a device microphone to determine whether a user is currently speaking or not. For example, the power of the signal can be measured to determine whether the user is speaking. In this regard, if the signal has a low average power level, it can be indicative that there is a break in speech. If there is silence or a gap between words, then the audio codec can be switched without being noticeable to the user. If, however, a period of active speech is detected, then switching the audio codec can be delayed. For example, the audio codec switch can be delayed until a silent period is detected. In some example embodiments, if a silent period is not detected within a defined maximum delay time, then the switch can be performed anyway.

Figure 10:
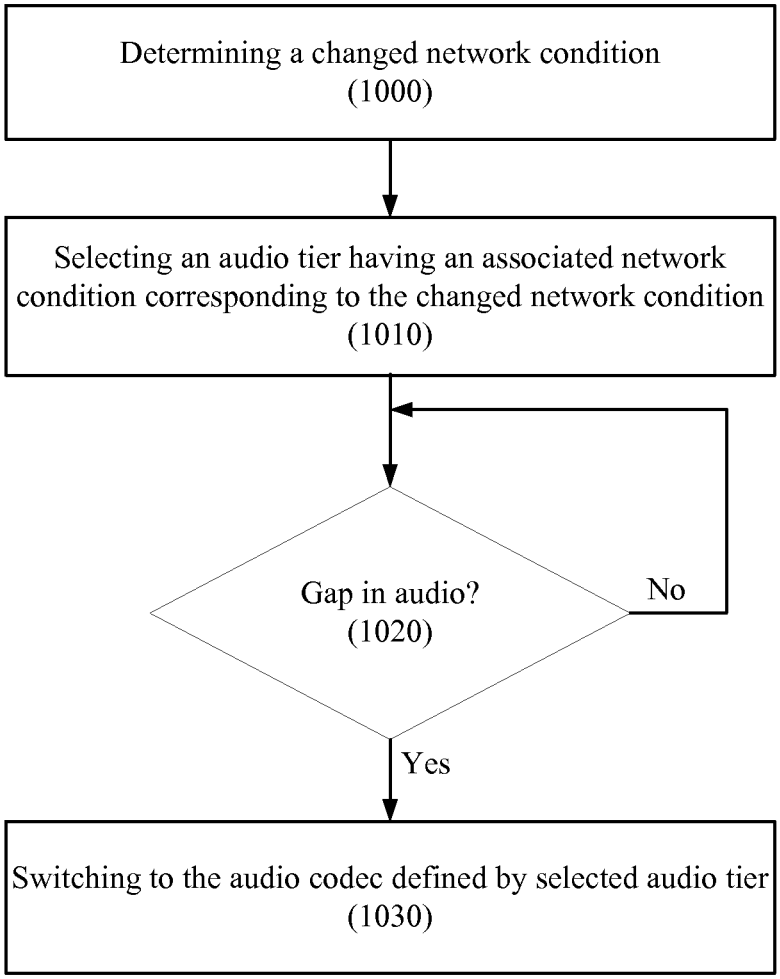
FIG. 10 illustrates a flow chart according to an example method for reducing the noticeability of an audio codec switch to a user in accordance with some example embodiments.

FIG. 10 illustrates a flow chart according to an example method for reducing the noticeability of an audio codec switch to a user in accordance with some such example embodiments. In this regard, FIG. 10 illustrates operations that can be performed by a communication device, such as wireless communication device 102, second communication device 104, calling wireless communication device 202, called wireless communication device 204, and/or the like, in accordance with some example embodiments. One or more of processor 302, transceiver 304, memory 306, processing circuitry 410, processor 412, memory 414, transceiver 416, or codec selection module 418 can, for example, provide means for performing the operations illustrated in and described with respect to FIG. 10.

Operation 1000 can include a communication device determining a changed network condition. The changed network condition can be a changed network condition sufficient to trigger switching audio codecs based on the audio tiers defined for the communication session. Operation 1010 can include the communication device selecting an audio tier having an associated network condition corresponding to the changed network condition.

Operation 1020 can include the communication device waiting for a gap in the audio prior to switching codecs. For example, the communication device can use speech activity detection techniques, audio signal power measurements, and/or other techniques to determine whether speech is ongoing, or if there is a gap in the audio. Operation 1030 can include the communication device switching to the audio codec defined by the selected audio tier during an audio gap. In some example embodiments, if an audio gap has not been detected in operation 1020 within a defined maximum delay time, the method can proceed to operation 1030 without waiting a further amount of time for an audio gap to occur.

In some example embodiments, cross fading can be used during an audio codec switch to reduce the detectability of any audio discontinuity. In this regard, if switching from a first audio codec to a second audio codec, audio encoded with the first audio codec can be faded down while audio encoded with the second audio codec can be faded up during the audio codec switch to reduce the level of discontinuity that can be heard by a user.

From the network perspective, audio encoded and transmitted in accordance with various example embodiments can appear as a continuous stream, such as a continuous RTP stream. In this regard, packet sequence numbers and time stamps can continue to increment without interruption or deviation following a codec switch. The audio payload in network packets can be marked with an audio codec indication that can indicate the audio codec used to encode the encoded audio data contained in the network packet. The audio codec indication can be usable by the receiving device to select the appropriate decoder for decoding the encoded audio data. The jitter buffer and RTP layer can remain unchanged from implementation of various example embodiments.

In some example embodiments, lower audio tiers can be limited only for use when there is no video data being exchanged for the communication session. In this regard, in some such embodiments, certain audio tiers can be used only when in audio only mode, such as in instances in which network bandwidth is not sufficient to support video streaming.

It will be appreciated that embodiments described with respect to use by wireless communication devices for communication sessions over wireless channels are provided by way of example, and not by way of limitation. As such, it will be appreciated that techniques described in connection with those embodiments can be implemented mutatis mutandis for adaptive codec switching by communication devices using wireline connections to engage in a communication session.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

In the foregoing detailed description, reference was made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments. For example, it will be appreciated that the ordering of operations illustrated in the flowcharts is non-limiting, such that the ordering of two or more operations illustrated in and described with respect to a flowchart can be changed in accordance with some example embodiments. As another example, it will be appreciated that in some embodiments, one or more operations illustrated in and described with respect to a flowchart can be optional, and can be omitted.

Further, the foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. The description of and examples disclosed with respect to the embodiments presented in the foregoing description are provided solely to add context and aid in the understanding of the described embodiments. The description is not intended to be exhaustive or to limit the described embodiments to the precise forms disclosed. It will be apparent to one of ordinary skill in the art that many modifications, alternative applications, and variations are possible in view of the above teachings. In this regard, one of ordinary skill in the art will readily appreciate that the described embodiments may be practiced without some or all of these specific details. Further, in some instances, well known process steps have not been described in detail in order to avoid unnecessarily obscuring the described embodiments.

What is claimed is:

1. A method for adaptive audio codec selection during a communication session over a wireless channel, the method comprising a wireless communication device:

negotiating a set of audio codecs for use during the communication session with a second communication device participating in the communication session, the set of audio codecs comprising a plurality of audio codecs that are supported by both the wireless communication device and the second communication device;

defining a plurality of audio tiers, each audio tier being associated with a respective network condition and defining an audio codec from the set of audio codecs for use in the associated network condition;

using a first audio codec from the set of audio codecs to encode audio data sent to the second communication device during a first portion of the communication session;

determining a changed network condition during the communication session; and in response to the changed network condition:

selecting an audio tier having an associated network condition corresponding to the changed network condition from the plurality of audio tiers; and switching from the first audio codec to a second audio codec for encoding audio data sent to the second communication device during a second portion of the communication session, the second audio codec being defined by the selected audio tier.

2. The method of claim 1, wherein each audio tier is associated with a respective network bit rate, and wherein:

determining the changed network condition comprises determining a changed network bandwidth available over the wireless channel; and selecting the audio tier comprises selecting an audio tier having an associated network bit rate corresponding to the changed network bandwidth.

3. The method of claim 1, wherein each audio tier further defines a codec bit rate and bundling factor, and wherein switching from the first audio codec to the second audio codec comprises using the second audio codec to encode audio data at the codec bit rate defined by the selected audio tier, and wherein the method further comprises the wireless communication device:

bundling encoded audio data encoded with the second audio codec into one or more network packets for transmission to the second communication device based on a bundling factor defined by the selected audio tier.

4. The method of claim 1, wherein the method further comprises the wireless communication device:

including an audio codec indication in a network packet containing encoded audio data sent to the second communication device during the communication session, wherein the audio codec indication indicates the audio codec used to encode the encoded audio data contained in the network packet and is usable by the second communication device to select a decoder to decode the encoded audio data contained in the network packet.

5. The method of claim 1, wherein defining the plurality of audio tiers comprises the wireless communication device:

defining a set of target network bit rate tiers;

generating a set of one or more codec parameter combinations for each audio codec in the set of audio codecs, wherein each codec parameter combination comprises a combination of a codec bit rate and a bundling factor supported by a respective audio codec;

determining a quality provided by each codec parameter combination;

calculating an overall network bit rate supported by each codec parameter combination; and for each target network bit rate tier, selecting a codec parameter combination providing the best quality of one or more codec parameter combinations supporting an overall network bit rate corresponding to the target network bit rate tier.

6. The method of claim 1, wherein:

in an instance in which the changed network condition comprises an improved network condition, the method further comprises the wireless communication device:

waiting for a delay period prior to switching from the first audio codec to the second audio codec;

determining whether the improved network condition continues to persist following the delay period; and switching from the first audio codec to the second audio codec only if it is determined that the improved network condition continues to persist following the delay period; and in an instance in which the changed network condition comprises a degraded network condition, the method comprises the wireless communication device switching from the first audio codec to the second audio codec without waiting for the delay period.

7. The method of claim 1, further comprising the wireless communication device:

determining whether the first audio codec can provide a quality satisfying a threshold quality at a codec bit rate defined by the selected audio tier;

switching from the first audio codec to the second audio codec only if it is determined that the first audio codec cannot provide the quality satisfying the threshold quality at the codec bit rate defined by the selected audio tier; and using the first audio codec at the codec bit rate defined by the selected audio tier to encode audio data sent to the second communication device subsequent to determining the changed network condition in an instance in which it is determined that the first audio codec can provide the quality satisfying the threshold quality at the codec bit rate defined by the selected audio tier.

8. The method of claim 1, further comprising the wireless communication device:

waiting for an audio gap in the communication session prior to switching from the first audio codec to the second audio codec; and switching from the first audio codec to the second audio codec during the audio gap.

9. The method of claim 1, wherein the communication session comprises a video call in which the wireless communication device and the second communication device are participating.

10. The method of claim 1, wherein the communication session comprises a voice call between the wireless communication device and the second communication device.

11. The method of claim 1, wherein the second communication device supports a radio access technology.

12. The method of claim 1, wherein each audio tier is further associated with a respective packet loss rate and wherein an audio tier is selected based on an observed packet loss rate such that error correction techniques, defined by the selected audio tier, are implemented to address the observed packet loss rate.

13. A wireless communication device comprising:

a transceiver configured to transmit data and receive data for a communication session over a wireless channel; and processing circuitry coupled to the transceiver, the processing circuitry configured to control the wireless communication device to at least:

negotiate a set of audio codecs for use during the communication session with a second communication device participating in the communication session, the set of audio codecs comprising a plurality of audio codecs that are supported by both the wireless communication device and the second communication device;

define a plurality of audio tiers, each audio tier being associated with a respective network condition and defining an audio codec from the set of audio codecs for use in the associated network condition;

use a first audio codec from the set of audio codecs to encode audio data sent to the second communication device during a first portion of the communication session;

determine a changed network condition during the communication session; and in response to the changed network condition:

select an audio tier having an associated network condition corresponding to the changed network condition from the plurality of audio tiers; and switch from the first audio codec to a second audio codec for encoding audio data sent to the second communication device during a second portion of the communication session, the second audio codec being defined by the selected audio tier.

14. The wireless communication device of claim 13, wherein each audio tier is associated with a respective network bit rate, and wherein the processing circuitry is further configured to control the wireless communication device to:

determine the changed network condition at least in part by controlling the wireless communication device to determine a changed network bandwidth available over the wireless channel; and select the audio tier at least in part by controlling the wireless communication device to select an audio tier having an associated network bit rate corresponding to the changed network bandwidth.

15. The wireless communication device of claim 13, wherein each audio tier further defines a codec bit rate and bundling factor, and wherein the processing circuitry is further configured to control the wireless communication device to:

switch from the first audio codec to the second audio codec at least in part by controlling the wireless communication device to use the second audio codec to encode audio data at the codec bit rate defined by the selected audio tier; and bundle encoded audio data encoded with the second audio codec into one or more network packets for transmission to the second communication device based on a bundling factor defined by the selected audio tier.

16. The wireless communication device of claim 13, wherein the processing circuitry is further configured to control the wireless communication device to define the plurality of audio tiers at least in part by controlling the wireless communication device to:

define a set of target network bit rate tiers;

generate a set of one or more codec parameter combinations for each audio codec in the set of audio codecs, wherein each codec parameter combination comprises a combination of a codec bit rate and a bundling factor supported by a respective audio codec;

determine a quality provided by each codec parameter combination;

calculate an overall network bit rate supported by each codec parameter combination; and for each target network bit rate tier, select a codec parameter combination providing the best quality of one or more codec parameter combinations supporting an overall network bit rate corresponding to the target network bit rate tier.

17. The wireless communication device of claim 13, wherein the processing circuitry is further configured to control the wireless communication device to:

wait for a delay period prior to switching from the first audio codec to the second audio codec;

determine whether the changed network condition continues to persist following the delay period; and switch from the first audio codec to the second audio codec only if it is determined that the changed network condition continues to persist following the delay period.

18. The wireless communication device of claim 13, wherein the processing circuitry is further configured to control the wireless communication device to:

determine whether the first audio codec can provide a quality satisfying a threshold quality at a codec bit rate defined by the selected audio tier;

switch from the first audio codec to the second audio codec only if it is determined that the first audio codec cannot provide the quality satisfying the threshold quality at the codec bit rate defined by the selected audio tier; and use the first audio codec at the codec bit rate defined by the selected audio tier to encode audio data sent to the second communication device subsequent to determining the changed network condition in an instance in which it is determined that the first audio codec can provide the quality satisfying the threshold quality at the codec bit rate defined by the selected audio tier.

19. The wireless communication device of claim 13, wherein the processing circuitry is further configured to control the wireless communication device to:

wait for an audio gap in the communication session prior to switching from the first audio codec to the second audio codec; and switch from the first audio codec to the second audio codec during the audio gap.

20. A non-transitory computer-readable storage medium, storing a set of computer program instructions, that when executed by one or more processors of a wireless communication device, cause the wireless communication device to:

negotiate a set of audio codecs for use during a communication session with a second communication device participating in the communication session, the set of audio codecs comprising a plurality of audio codecs that are supported by both the wireless communication device and the second communication device;

define a plurality of audio tiers, each audio tier being associated with a respective network condition and defining an audio codec from the set of audio codecs for use in the associated network condition;

use a first audio codec from the set of audio codecs to encode audio data sent to the second communication device during a first portion of the communication session;

determine a changed network condition during the communication session; and in response to the changed network condition:

select an audio tier having an associated network condition corresponding to the changed network condition from the plurality of audio tiers; and switch from the first audio codec to a second audio codec for encoding audio data sent to the second communication device during a second portion of the communication session, the second audio codec being defined by the selected audio tier.

* * * * *